US011852440B2

(12) United States Patent
Dunning et al.

(10) Patent No.: US 11,852,440 B2
(45) **Date of Patent: *Dec. 26, 2023**

(54) RIFLESCOPE CAP ASSEMBLY

(71) Applicant: BUSHNELL INC., Overland Park, KS (US)

(72) Inventors: Joe B. Dunning, Oroville, CA (US); Aden P. Wright, Chico, CA (US); Monte N. Koenigs, Overland Park, KS (US)

(73) Assignee: Bushnell Inc., Overland Park, KS (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/101,016

(22) Filed: Jan. 24, 2023

(65) Prior Publication Data

US 2023/0168065 A1 Jun. 1, 2023

Related U.S. Application Data

(63) Continuation of application No. 17/473,641, filed on Sep. 13, 2021, now Pat. No. 11,609,068, which is a continuation of application No. 16/891,854, filed on Jun. 3, 2020, now Pat. No. 11,150,053.

(51) Int. Cl.
*F41G 1/38* (2006.01)
*F41G 1/04* (2006.01)
*F41G 1/06* (2006.01)

(52) U.S. Cl.
CPC ..... *F41G 1/383* (2013.01); *F41G 1/04* (2013.01); *F41G 1/065* (2013.01)

(58) Field of Classification Search
CPC ..... F41G 1/383; F41G 1/04; F41G 1/065
USPC ..... 42/129
See application file for complete search history.

(56) References Cited

U.S. PATENT DOCUMENTS 2,849,795 A * 9/1958 Vissing ..... F41G 1/383 42/129
5,495,676 A * 3/1996 Chesnut ..... F41G 1/383 42/129
5,561,563 A * 10/1996 Chesnut ..... F41G 1/383 359/822

(Continued)

OTHER PUBLICATIONS

International Search Report and Written Opinion in related application No. PCT/US21/34890, dated Jun. 30, 2021.

(Continued)

*Primary Examiner* — John Cooper
(74) *Attorney, Agent, or Firm* — Reed Smith LLP; Walter M. Egbert, III; Richard J. Brown

(57) ABSTRACT

A scope cap assembly for mounting on a scope of a firearm is provided, including a resilient sleeve for mounting to the scope of the firearm; a support body fixed to the resilient sleeve and including a mounting portion; a cap defining an aperture and pivotably mounted to the support body and movable between a closed position and an open position greater than 180 degrees from the closed position; a biasing member for biasing the cap towards the open position; a retaining mechanism for releasably securing the cap at an intermediate position between the closed position and the open position; and a first removable disc configured for placement within the second aperture and defining a annular protrusions for cooperating with annular flanges of the cap to secure the first removable disc in the cap.

20 Claims, 12 Drawing Sheets

(56) References Cited

U.S. PATENT DOCUMENTS 6,289,625 B1 * 9/2001 Phares ..... F41G 1/383 42/129
6,416,189 B1 * 7/2002 Watson ..... G02B 23/16 359/511
6,799,854 B1 * 10/2004 Steiner ..... G02B 23/16 359/612
6,811,268 B2 * 11/2004 Watson ..... F41G 1/383 42/129
7,546,931 B2 * 6/2009 Giusti ..... B01L 3/50825 220/366.1
7,721,480 B2 * 5/2010 Campean ..... G02B 7/006 42/129
D640,556 S * 6/2011 Bragg ..... D9/449
9,885,541 B2 * 2/2018 Meinert ..... F41G 1/38
9,945,639 B1 * 4/2018 Geraci ..... G02B 27/0025
10,240,897 B2 * 3/2019 Hamilton ..... G02B 23/16
10,288,379 B2 * 5/2019 Meinert ..... F41C 23/16
D884,107 S * 5/2020 Meinert ..... D22/108
2006/0191933 A1 * 8/2006 Hicks ..... B65D 47/0804 220/259.2
2006/0218841 A1 * 10/2006 Campean ..... G02B 23/16 42/129
2010/0095577 A1 * 4/2010 Tsai ..... F41G 1/383 42/129
2014/0319216 A1 * 10/2014 Meinert ..... F41G 1/18 235/404
2015/0253107 A1 * 9/2015 Hamilton ..... G02B 23/16 42/111
2015/0285589 A1 * 10/2015 Hamilton ..... F41G 1/383 42/143
2017/0299334 A1 * 10/2017 Hamilton ..... F41G 3/08

OTHER PUBLICATIONS

First Office Action in related application No. TW110119769; dated Mar. 28, 2022 (TW translation begins on p. 4).

* cited by examiner

RIFLESCOPE CAP ASSEMBLY

CROSS REFERENCE TO RELATED APPLICATIONS

This document is a continuation of U.S. Utility patent application Ser. No. 17/473,641, filed Sep. 13, 2021; which is a continuation of U.S. Utility patent application Ser. No. 16/891,854, filed Jun. 3, 2020, now U.S. Pat. No. 11,150,053, issued Oct. 19, 2021, entitled "RIFLESCOPE CAP ASSEMBLY", of which the contents of all are hereby incorporated by reference.

FIELD

The disclosed subject matter relates to a riflescope cap system having a cap mounting system that allows for multiple positions and arrangements of the cap with respect to the scope.

DESCRIPTION OF RELATED ART

The use of sighting and aiming devices for firearms typically includes the use of telescopic sights and scopes. Such scopes include a single tube fabricated from metal or other materials and housing optics to gather and/or magnify light. Such scopes include an objective end in which light enters the scope and an ocular, or eyepiece, end that is in close proximity to the eye of the hunter or shooter. The scopes will often include a reticle to assist the user to align the scope with the target. The scope is typically attached to the firearm in a fixed manner, which allows the user to align the firearm with the target while aligning the scope with the target.

The objective and eyepiece ends of the scope include exposed optics which are typically precision glass optics that are highly susceptible to damage by scratching or to reduced effectiveness when exposed to moisture, ice, or dust.

Experience hunters and shooters will typically rely on information to improve the accuracy of their shoot. Such information can include environmental information such as distance, pressure, temperature, wind speed and elevation. The user can also consider information of the equipment such as scope height, muzzle velocity and ammunition type, weight, and drag characteristics. The information is referred to as "Data on Personal Equipment" (DOPE).

Hunters or shooters have come to provide DOPE on their firearms for easy reference while shooting, e.g., by the use of log books. However, users can face challenges when finding ways to easily access the information during a shoot. For example, in an adverse weather condition, DOPE notations can be subject to water damage or loss. However, DOPE is not needed for every shoot. In some cases, the user only needs to rely on the scope for a shoot.

Accordingly, there is a need for a scope cap system that meets the changing needs of hunters and shooters while avoiding the need for multiple pieces of equipment.

SUMMARY

In one aspect of the disclosed subject matter, a scope cap assembly for mounting on a scope of a firearm is provided, including a resilient sleeve for resiliently mounting about the outer portion of the scope of the firearm; a support body fixed to the resilient sleeve and defining a first aperture for alignment with the line of sight of the optics of the scope and a rim positioned about the first aperture, the support body including a mounting portion; a cap defining a second aperture therethrough and a set of annular flanges positioned about the second aperture, the cap pivotably mounted to the support body at the mounting portion and movable between a closed position in approximation with the rim of the support body such that the first aperture and the second aperture are in alignment with the line of sight of the optics of the scope, and an open position greater than 180 degrees from the closed position; a biasing member in engagement with the support body and the cap for biasing the cap towards the open position; a retaining mechanism for releasably securing the cap at an intermediate position between the closed position and the open position; and a first removable disc configured for placement within the second aperture and defining a set of annular protrusions for cooperating with the set of annular flanges of the cap to secure the first removable disc in the cap.

In some embodiments, the retaining mechanism releasably secures the cap in the open configuration. In some embodiments, the retaining mechanism includes a raised protrusion and a recess. In some embodiments the open position is about 270 degrees from the closed position, and the intermediate position is about 180 degrees from the closed position.

In some embodiments, the resilient sleeve is fabricated from Liquid Silicone Rubber (LSR). In some embodiments, the mounting body and the cap are fabricated from polypropylene.

In some embodiments, the first removable disc is transparent. In some embodiments, the first removable disc is opaque. In some embodiments, a second removable disc is provided that displays ballistic DOPE. In some embodiments, a washer is disposed proximate to the second aperture.

In another aspect of the disclosed subject matter, a scope cap assembly for mounting on a scope of a firearm is provided, including a resilient sleeve for resiliently mounting about the outer portion of the scope of the firearm; a support body fixed to the resilient sleeve and defining a first aperture for alignment with the line of sight of the optics of the scope and a rim positioned about the first aperture, the support body including a mounting portion; a cap defining a second aperture therethrough and a set of annular flanges positioned about the second aperture, the cap pivotably mounted to the support body at the mounting portion and movable between a closed position in approximation with the rim of the support body such that the first aperture and the second aperture are in alignment with the line of sight of the optics of the scope, and an open position greater than 180 degrees from the closed position; a biasing member in engagement with the support body and the cap for biasing the cap towards the open position; a retaining mechanism for releasably securing the cap at an intermediate position between the closed position and the open position; a first removable disc that displays ballistic DOPE configured for placement within the second aperture; a second removable transparent disc configured for placement within the second aperture; wherein one of the first and second removable discs include annular protrusions for cooperating with the set of annular flanges of the cap to secure the first removable disc in the cap.

In some embodiments, the biasing member is a torsion spring. In some embodiments, the cap further defines a release lever. In some embodiments, a pin is disposed between the mounting portion of the support body and the cap to allow pivotable movement of the cap.

BRIEF DESCRIPTION OF THE DRAWINGS

The disclosed aspects will hereinafter be described in conjunction with the appended drawings, provided to illustrate and not to limit the disclosed aspects, wherein like designations denote like elements.

DETAILED DESCRIPTION OF EXEMPLARY EMBODIMENTS

Figure 1:
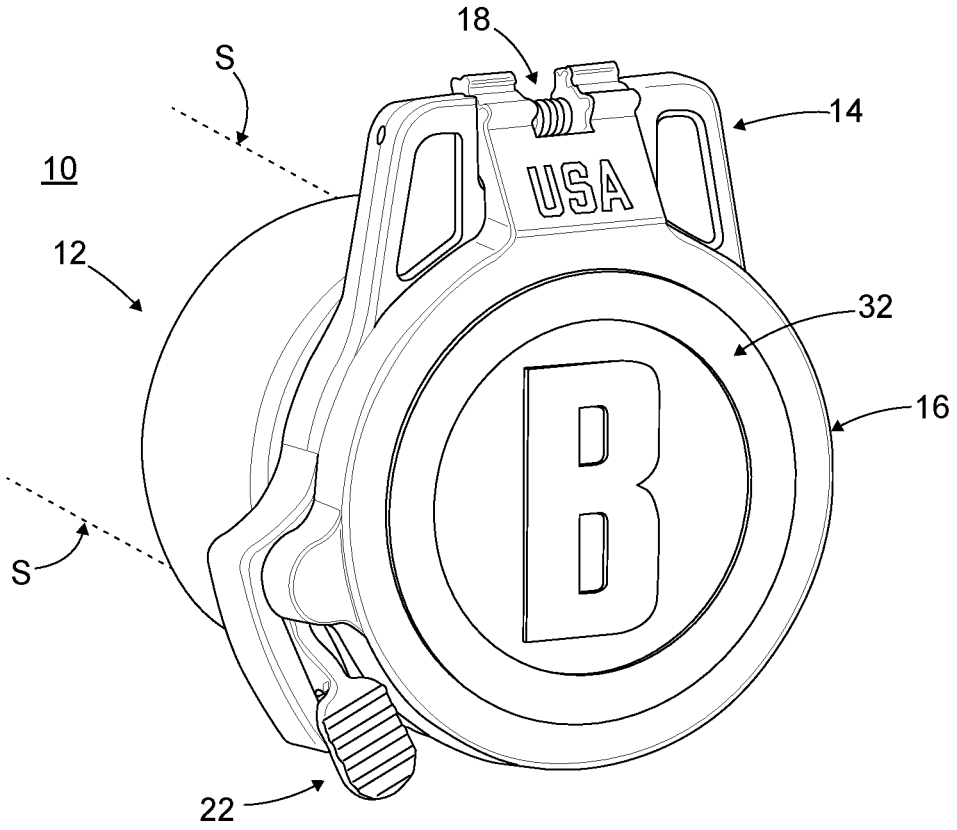
FIG. 1 is a perspective view of a scope cap from the user perspective in accordance with an exemplary embodiment of the disclosed subject matter.

Various aspects of the apparatuses and methods disclosed herein are described more fully hereinafter with reference to the accompanying drawings. This disclosure may, however, be embodied in many different forms and should not be construed as limited to any specific structure or function presented throughout this disclosure.

The scope cap assemblies described herein provide improved functionality when used with a scope for a firearm. Firearm scopes include an eyepiece end and an objective end. As such, the eyepiece end portion is positioned nearer to the user's eye during use, and is often referred to as the "proximal" or "user" end portion of the scope. Likewise, the objective end of the scope is positioned furthest from the user and is often referred to as the "distal" or "objective" end portion of the scope. Each of the objective and eyepiece ends of the scope is exposed to potential damage such a scratches or exposure to the elements, such as rain or snow. Accordingly, the scope cap assemblies described herein are configured for use at the objective end, or alternatively at the eyepiece end. As used herein, a scope cap assembly used at the objective end is sometimes referred to as an "objective scope cap assembly," and a scope cap assembly used at the eyepiece end is sometimes referred to as an "eyepiece scope cap assembly." Generally, the construction of the objective cap assembly and eyepiece cap assembly are identical, except as described below. The objective end of the scope is generally larger than the eyepiece end, and the sizing of the scope cap assembly for use therewith will reflect such dimensions. Moreover, when the scope cap assembly is positioned on the objective end of the scope, the cap is configured to allow the DOPE disc to be visible to the hunter or shooter when attached to the scope, and thus will be positioned on the outer side of the cap as described herein.

Typically, the eyepiece and objective ends of the scope are substantially cylindrical in shape, with a range of outer diameters. The scope cap assemblies described herein are designed to allow a single size scope assembly to provide a secure fit with firearm scopes of different dimensions. Accordingly, the scope cap assembly incorporates two materials. A sleeve is fabricated from a flexible, resilient material such as Liquid Silicone Rubber (LSR). The resilient sleeve is configured for resiliently mounting about the outer portion of the scope of the firearm. The resilient material of the sleeve is capable of stretching to securely accommodate a number of different sized scopes. A body portion and a hinged or pivoting cap provide sufficient rigidity to protect the scope optics from damage and allow for the mounting of a number of different insertable discs as will be described below. Accordingly, the body portion and the hinged cap are fabricated from a material such as polypropylene.

The scope cap is configured to allow a plurality of insertable discs to fit within the hinged cap. In certain embodiments, two inner polymer discs are provided, one transparent and one opaque, and a third disc that includes ballistic information legible to the hunter or shooter, e.g., a DOPE disc. Each of the insertable discs is removable and interchangeable to accommodate different hunting or shooting environments.

The scope cap including the insertable discs can be used in several different arrangements for different shooting environments and preferences. First, the opaque disc can be inserted into the hinged cap. When in a closed position, it will protect the scope optics from scratches as well as harsh elements such as dust, rain or snow.

Second, the transparent lens can be used to provide similar protection for the scope lens from scratches and the elements, but also allows the hunter or shooter to use the firearm when the cap is closed. That is, the transparent cover allows the hunter or shooter see through the cap(s) to view the scope reticle and take a shot.

Third, a DOPE disc can be provided for insertion into the scope cap to show a shooter ballistic data. In some embodiments, the DOPE disc is customized and printed by the user on paper or other similar material. As will be described below, the DOPE disc is positioned in the hinged cap, and a transparent cover or disc is provided over the DOPE disc to protect the DOPE disc from the elements during use. In some arrangements, the DOPE disc in positioned on the outer portion of the hinged cap of an objective scope cap so that the ballistic information faces the shooter when the cap is opened 180 degrees. In some embodiments, the DOPE disc information is placed in the inner portion of the hinged cap of an eyepiece scope cap so the ballistic data can be viewed by the hunter or shooter once the cap is opened 180 degrees. A transparent disc is provided to cover the DOPE disc to protect the printed paper or other material from the elements.

FIG. 1 illustrates the scope cap assembly 10 in accordance with an embodiment of the disclosed subject matter. The substantially cylindrical end portion of the scope S is indicated in dashed line. The scope cap assembly 10 includes a resilient sleeve 12, a base 14 and a cap 16. The resilient sleeve 12 can be fabricated from LSR over-molded onto the base 14, which is typically fabricated from polypropylene. The cap 16, also fabricated from a material such as polypropylene, is pivotably mounted to the base 14 via a hinge mechanism such as a steel torsion spring 18 and hinge pin 20 (shown in FIG. 2). As will be described below, the cap 16 includes a three position lock, that allows the cap 16 to be positioned in a closed configuration as shown in FIG. 1 in which the cap 16 is proximate to the rim 31 of the base 14; an intermediate configuration, about 180 degrees "up" from the closed position (see FIGS. 7-8) and fully open "flat-to-rear" configuration, about 270 degrees back from the closed configuration (see FIGS. 9-10). The torsion spring 18 can be configured to bias the hinged cap 16 to the partially open position of FIG. 6. The scope cap assembly 10 optionally includes an opening lever 22 that keeps the hinged cap 16 in the closed position, and when actuated, allows the spring 18 to bias the cap 16 towards the partially open position.

Figure 2:
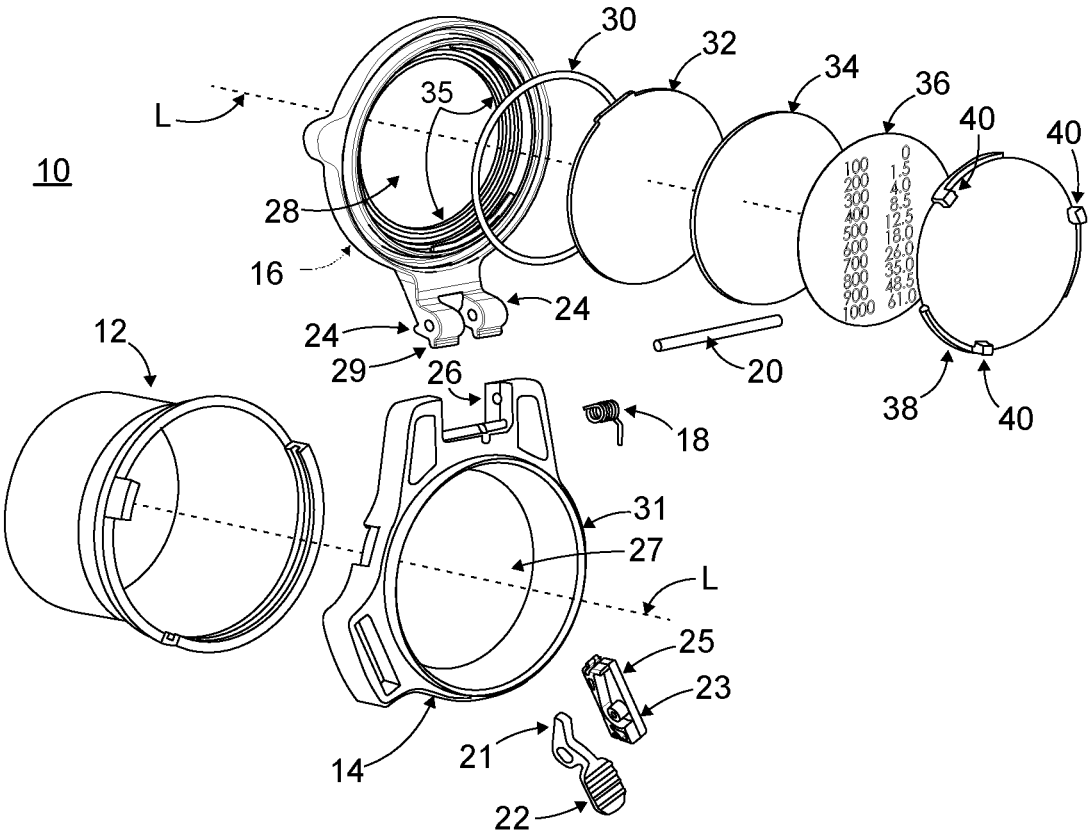
FIG. 2 is a perspective view with parts separated of the scope cap of FIG. 1.

As illustrated in FIG. 2, the hinged cap 16 is pivotably mounted to the base 14 via a stainless steel hinge pin 20 that slides through apertures 24 in cap 16 and corresponding apertures 26 in base 14.

Base 14 includes a rim 31 surrounding an aperture 27, and cap 16 includes an aperture 28. Both apertures 27 and 28 are aligned with the line of sight of the scope, indicated by dotted line L so that the placement of the scope cap assembly 10 on the scope does not interfere with the user's ability to view the target and the reticle therethrough. Aperture 28 in the cap 16 allows for the arrangement of the interchangeable discs 32, 34, 36, 38 in the cap 16. An integrated LSR sealing washer 30 can be over-molded into cap 16 to provide a watertight seal when interchangeable discs are in place.

Figure 3:
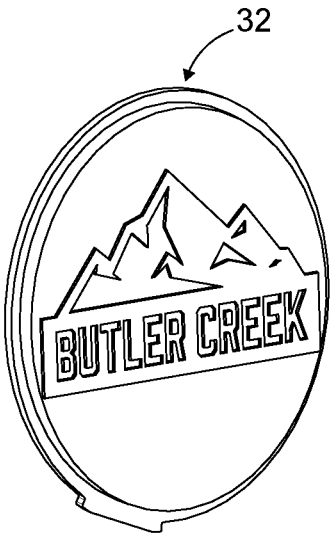
FIGS. 3-5 are perspective views of components of the scope cap.
Figure 5:
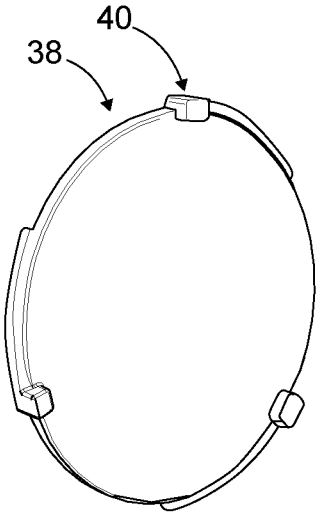

With continued reference to FIG. 2, several arrangements are available to a hunter or shooter by the scope cap design. In a first arrangement, a solid opaque disc 32 can be inserted into aperture 28 and locked into position within cap 16. Solid disc 32 can engage washer 30 to provide a watertight seal. (See also FIG. 3) In some embodiments, locking lens 38, which is a transparent plastic such as a polycarbonate, is secured in cap 16 via a series of annular protrusions 40 that lock into a series of annular flanges 35 in cap 16 in bayonet fashion. (See also FIG. 5)

Figure 4:
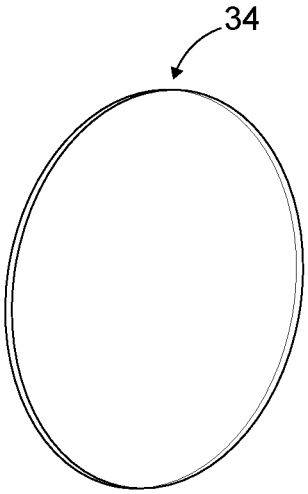

In a second arrangement, a transparent lens 34 is used instead of solid opaque disc 32 to provide a see-through arrangement along the line of sight L of the scope. Transparent lens 34 can be made from a transparent plastic, such as polycarbonate. (See also FIG. 4) Locking lens 38 is secured in cap 16 in bayonet fashion via interaction of annular flanges/protrusions as discussed above.

In a third arrangement, a disc having DOPE ballistic information 36 can be installed in cap 16. The DOPE disc 36 can be used with the solid opaque disc 32 or the transparent lens 34 and locking lens 38. For example, if it is desired that DOPE disc 36 is visible from the interior side of the cap 16, then solid opaque disc 32 is first positioned within aperture 28 of cap 16, creating a watertight seal with washer 30. Subsequently, DOPE disc 36 is placed on top of solid disc 32 such that the ballistics information is facing the interior side of the cap 16, and next locking lens 38 is mounted to hold lens 38, opaque disc 32 and DOPE disc 36 in place. For clarification, the "interior" side of the cap 16 is the side of the cap 16 that is closest to the base 14 when the cap 16 is closed. If it is desired that DOPE disc 36 is visible from the outer side of the cap 16, then transparent lens 34 is first positioned within aperture 28 of cap 16, creating a watertight seal with washer 30. Subsequently, DOPE disc 36 is placed on top of solid disc 32 such that the ballistics information is facing the outer side of the cap 16, and next locking lens 38 is mounted to hold lens 38, opaque disc 32 and DOPE disc 36 in place. (For clarification, the "outer" side of the cap 16 is the side of the cap 16 that is farthest from the base 14 when the cap 16 is closed.)

Figure 6:
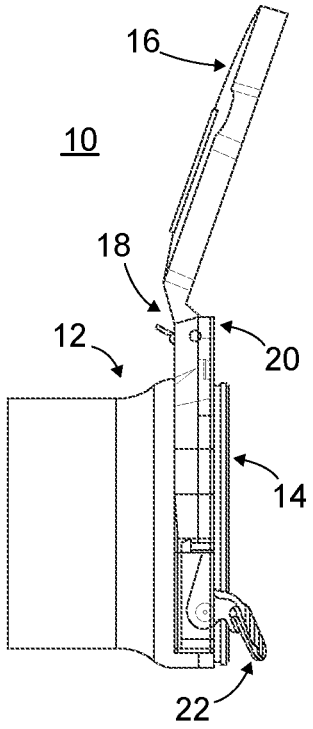
FIG. 6 is a side view of the scope cap of FIG. 1 in an intermediate position.
Figure 7:
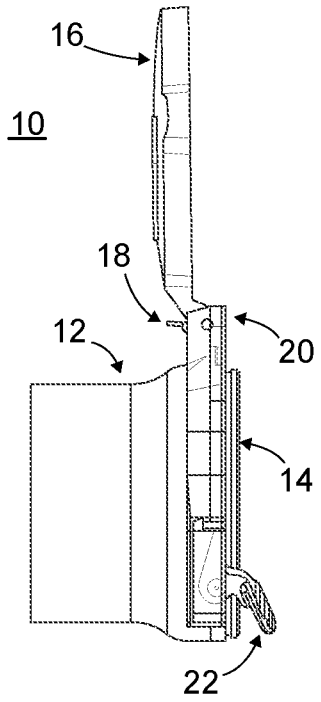
FIG. 7 is a side view of the scope cap of FIG. 1 in a upright configuration.
Figure 8:
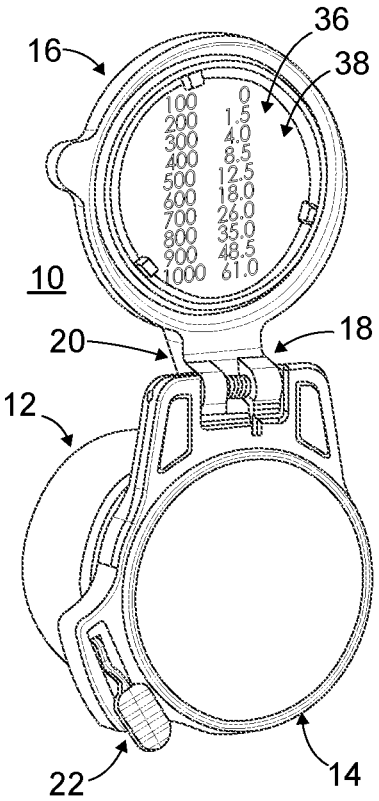
FIG. 8 is a perspective view of the scope cap of FIG. 1 in an upright configuration from the user perspective.

As illustrated in FIG. 6, the scope cap assembly 10 is in a partially open configuration. In some embodiments, lever 22 is used to release the cap 16 from a closed/locked position. Lever 22 is depressed by the user's finger, such that the lever 22 pivots about pin 23 disposed on receptacle plate 25 received in base 14. The torsion spring 18 is used to bias the cap 16 to the partially open position. FIGS. 7 and 8 illustrate the scope cap assembly 10 in an intermediate configuration. In some embodiments, the cap 16 can be releasably secured in this position. For example, the cap 16 may be provided with a retaining mechanism, e.g., a raised bump or ridge 29 that fits in a dimpled or recessed configuration in the base 14 (not shown) such that the cap 16 is releasably retained in this configuration, but additional manual force by the user can move the cap to other positions, e.g., closed or flat-to-rear configurations.

Figure 9:
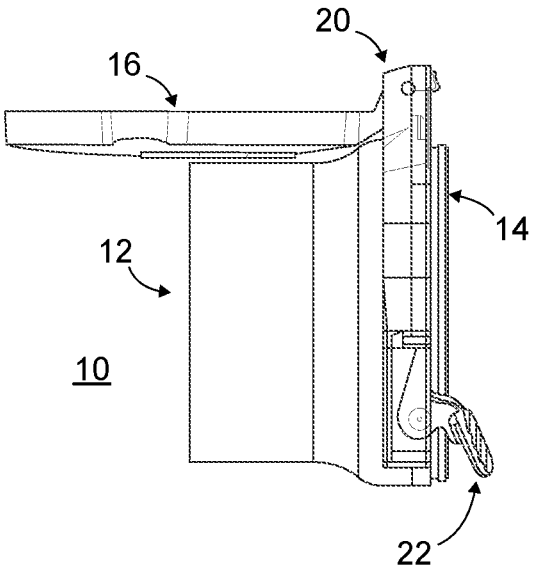
FIG. 9 is a side view of the scope cap of FIG. 1 in an open "flat to rear" configuration.
Figure 10:
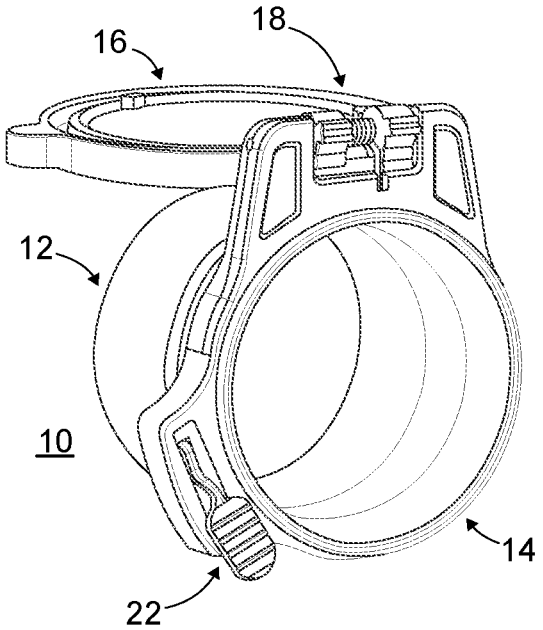
FIG. 10 is a perspective view of the scope cap of FIG. 1 in an open "flat to rear" configuration from the user perspective.

As illustrated in FIGS. 9 and 10, the cap 16 can be moved against the bias of the torsion spring 18 to a fully open, e.g., the "flat to rear configuration," for example, about 270 degrees from the closed position. The cap 16 may be also releasably secured in this configuration by a retaining mechanism. For example, the cap 16 may be provided with a raised bump 31 (discussed above) that fits in the dimpled or recessed configuration in the base 14 such that the cap 16 is releasably retained in this "flat-to-rear" configuration, but additional manual force by the user can move the cap to other positions, upright or closed configurations.

Figure 11:
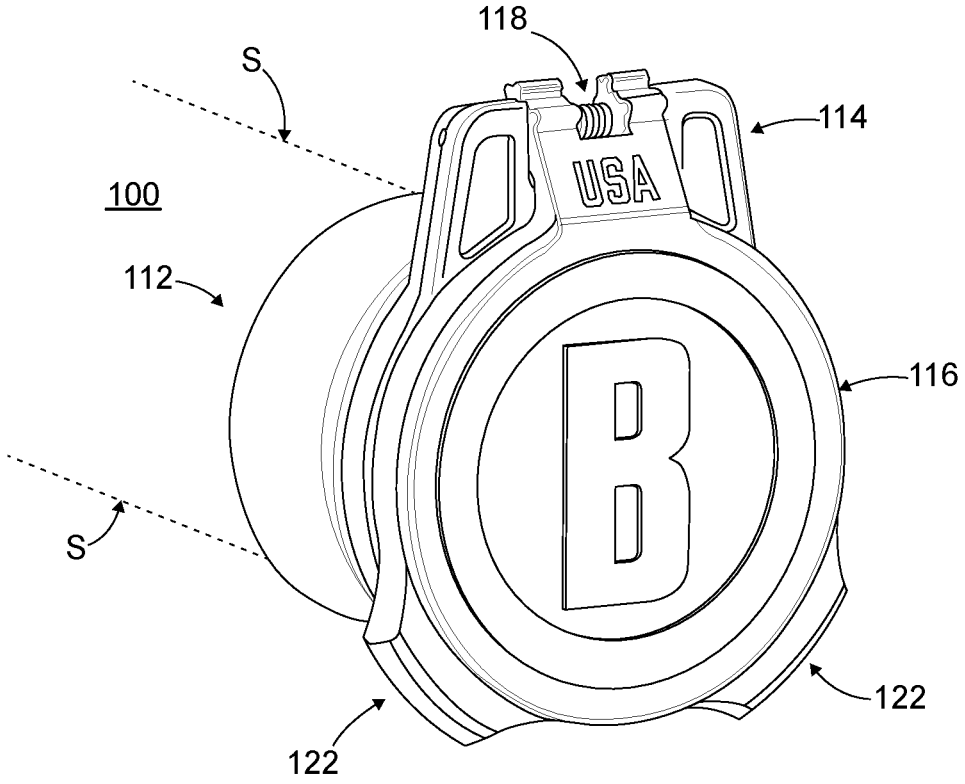
FIG. 11 is a perspective view of a scope cap in an assembled configuration from the distal perspective in accordance with another embodiment of the disclosed subject matter.
Figure 12:
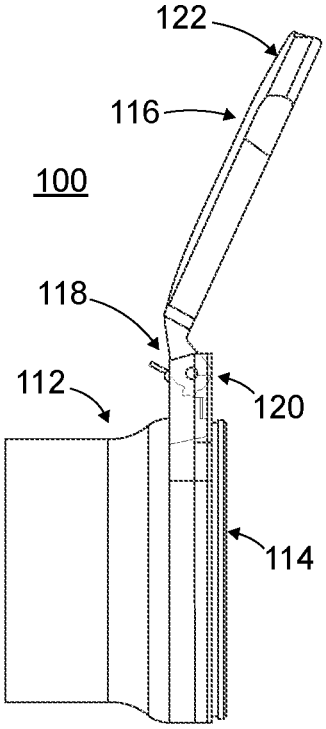
FIG. 12 is a side view of the scope cap of FIG. 11 in a partially open configuration.
Figure 13:
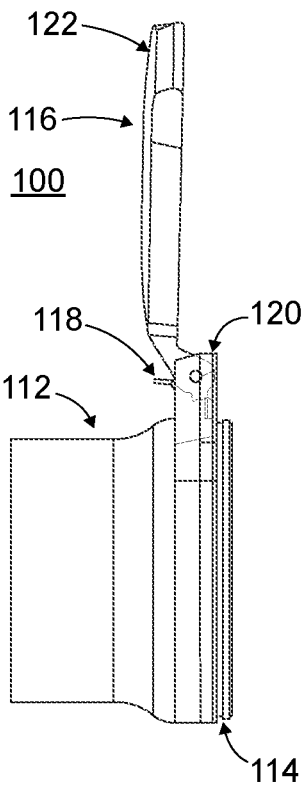
FIG. 13 is a side view of the scope cap of FIG. 11 in an upright configuration.
Figure 14:
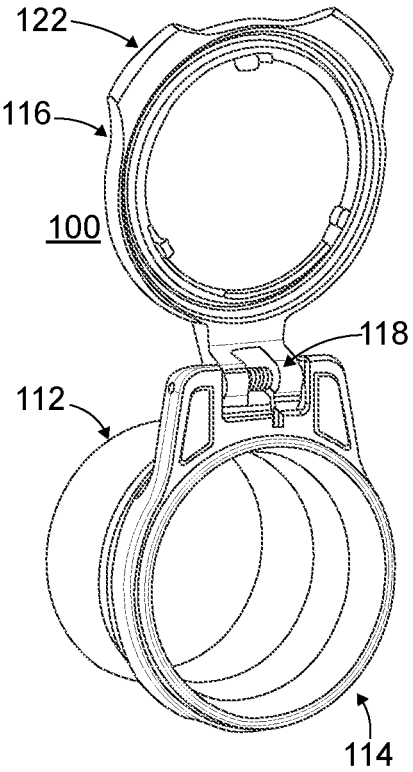
FIG. 14 is a perspective view of the scope cap of FIG. 11 in the upright configuration from the distal perspective.
Figure 15:
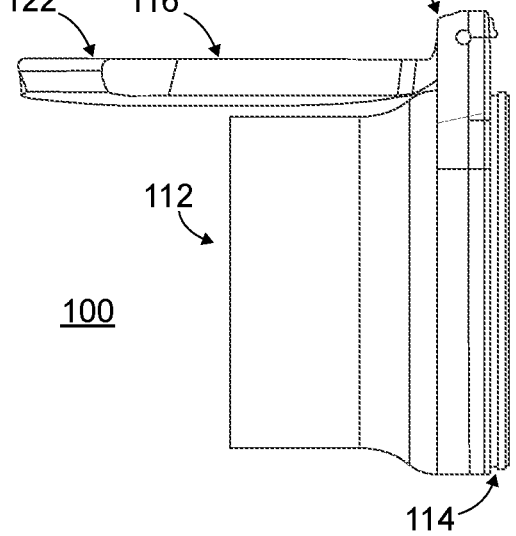
FIG. 15 is a side view of the scope cap of FIG. 11 in a flat to rear configuration.
Figure 16:
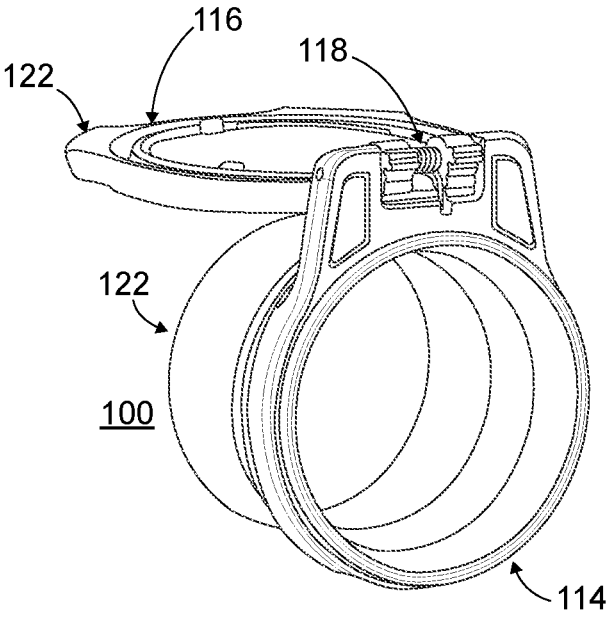
FIG. 16 is a perspective view of the scope cap of FIG. 15 in a flat to rear configuration from the distal perspective.

FIGS. 11-16 illustrate a scope cap assembly 100 in accordance with another embodiment of the disclosed subject matter. Scope cap assembly 100 is substantially identical to scope cap assembly 10, with the significant difference highlighted herein. For example, scope cap assembly 100 is useful as an objective scope cap. Scope cap assembly 100 may include a set of tabs 122 to facilitate opening of the cap 116 by the user. As illustrated in FIG. 11, scope cap assembly 100 includes a resilient sleeve 112, base 114 and hinged cap 116. The hinged cap 116 is pivotably mounted to the base 114 via a hinge mechanism such as a steel torsion spring 118 and hinge pin 120 (not shown in FIG. 11). The cap 116 includes a three position lock, that allows the cap 116 to be positioned in a closed configuration as shown in FIG. 11, an open configuration, about 180 degrees "up" from the closed position (see FIGS. 13-14) and a fully open "flat-to-rear" configuration, locked about 270 degrees back from the closed configuration (see FIGS. 15-16).

Figure 17:
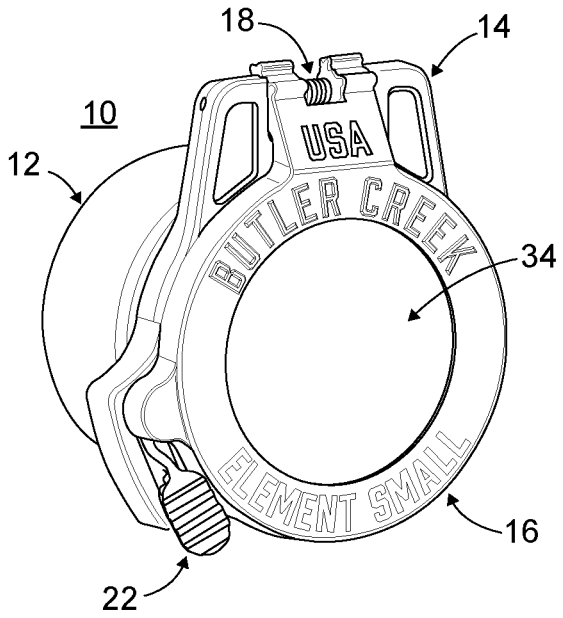
FIG. 17 is a perspective view of the scope cap of FIG. 1 in the closed configuration from the user perspective with parts arranged in another arrangement.
Figure 18:
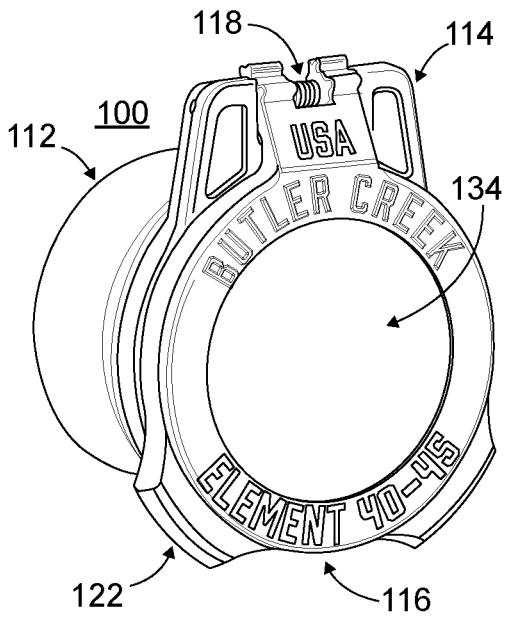
FIG. 18 is a perspective view of the scope cap of FIG. 11 in the closed configuration from the distal perspective with parts arranged in another arrangement.

The various arrangements of the insertable discs in scope cap assemblies 10 and 100 will now be described in greater detail. FIG. 17 illustrates eyepiece scope cap assembly 10 in the closed configuration with the transparent lens 34 positioned within aperture 28 of cap 16. Similarly, FIG. 18 illustrates objective scope cap assembly 100 in the closed configuration with the transparent lens 134 in place in the cap 116. In the configurations shown in FIGS. 17 and 18, the user is able to see through the scope while being afforded protection of the scope optics from the elements.

Referring back to FIG. 8, scope cap assembly 10 is illustrated as an eyepiece scope cap assembly in the upright configuration with the DOPE disc 36 covered by the locking lens 38 positioned on the inner surface of the cap 16, such that the ballistic data on the DOPE disc 36 is legible to the hunter or shooter. In this configuration, the solid lens 32 is first positioned on the washer (not shown), followed by the DOPE disc 36, followed the transparent locking lens 38.

Figure 19:
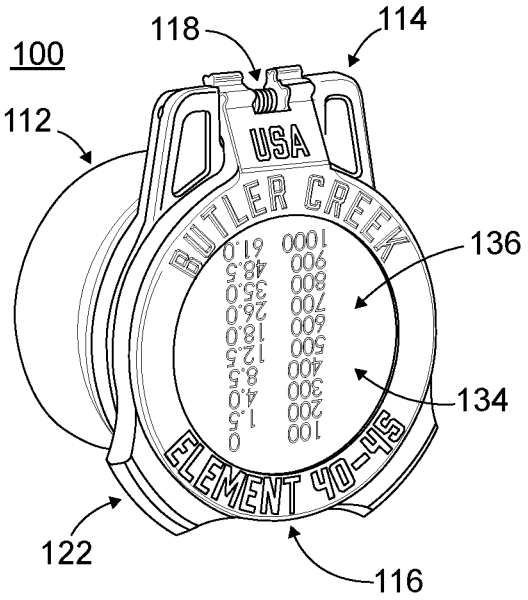
FIG. 19 is a perspective view of the scope cap of FIG. 11 in the closed configuration from the user perspective with parts arranged in a further arrangement.
Figure 20:
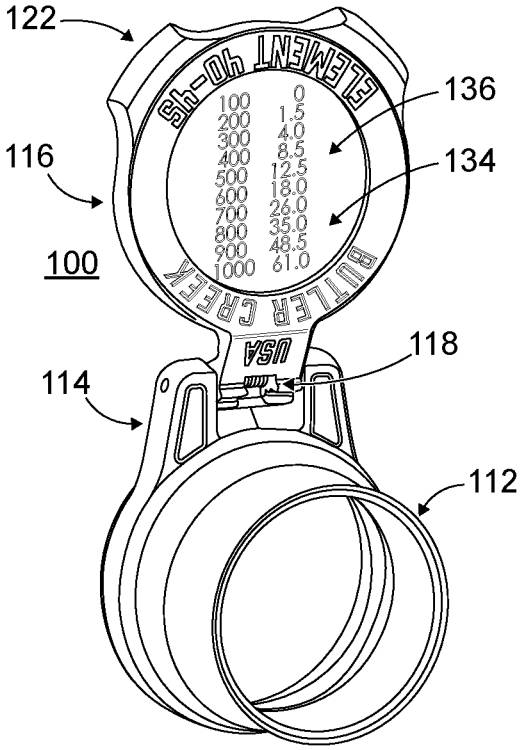
FIG. 20 is a perspective view of the scope cap of FIG. 11 in the closed configuration from the user perspective with parts arranged in a further arrangement.

FIGS. 19-20 illustrate scope cap assembly 100 being used as an objective scope cap assembly with the DOPE disc 136 positioned on the outer surface of the cap 116, such that the ballistic data on the DOPE disc 136 is legible to the hunter or shooter. In this configuration, the transparent lens 134 is first positioned in aperture 28 on the washer 30 (not shown in FIGS. 19-20), followed by the DOPE disc 136, followed by locking lens 134 (not shown).

Figure 21:
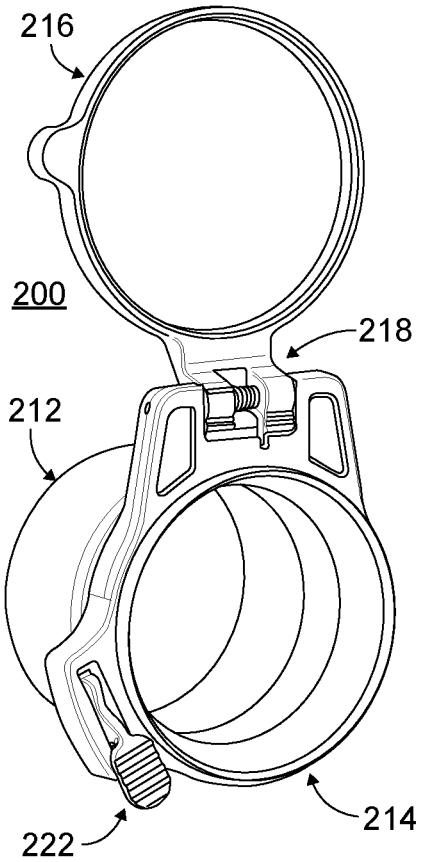
FIG. 21 is a perspective view of a scope cap in the upright configuration from the user perspective in accordance with an exemplary embodiment of the disclosed subject matter.
Figure 22:
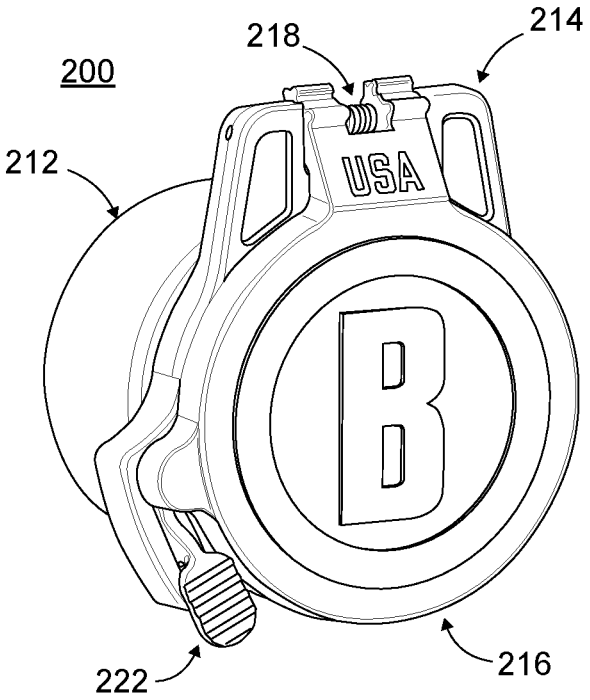
FIG. 22 is a perspective view of the scope cap of FIG. 21 in a closed configuration from the user perspective.

FIGS. 21-22 illustrate a further embodiment of the scope cap assembly 200 in accordance with an exemplary embodiment of the subject matter. Scope cap assembly 200 is substantially identical to the scope cap assembly 10 described herein, with substantial differences described herein. For example, cap 216 has a fixed configuration such that the solid opaque disc is integrally formed with the cap 216. In further embodiments, a transparent lens may be fixed within the cap 216 instead of the opaque disc.

Figure 23:
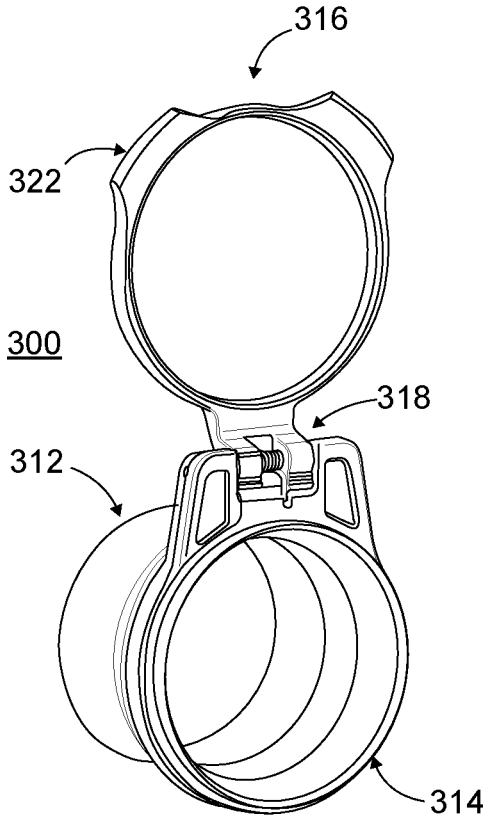
FIG. 23 is a perspective view of a scope cap in the upright configuration from the user perspective in accordance with another exemplary embodiment of the disclosed subject matter.
Figure 24:
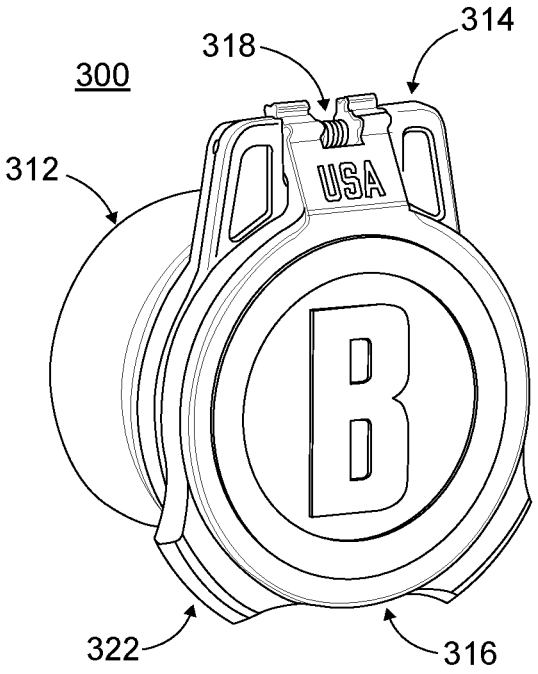
FIG. 24 is a perspective view of the scope cap of FIG. 23 in a closed configuration from the user perspective.

FIGS. 23-24 illustrate a further embodiment of the scope cap assembly 300 in accordance with an exemplary embodiment of the subject matter. Scope cap assembly 300 is substantially identical to the scope cap assembly 100 described herein, with substantial differences described herein. For example, cap 316 has a fixed configuration such that the solid disc is integrally formed with the cap 316. In further embodiments, a transparent lens may be fixed within the cap 316 instead of an opaque disc.

While the disclosure has been illustrated and described in detail in the drawings and foregoing description, such illustration and description are to be considered illustrative or exemplary and not restrictive. The disclosure is not limited to the disclosed embodiments. Variations to the disclosed embodiments and/or implementations can be understood and effected by those skilled in the art in practicing the claimed disclosure, from a study of the drawings, the disclosure and the appended claims.

What is claimed is:

1. A scope cap assembly for mounting on an eyepiece end of a scope of a firearm, comprising:

a support body defining a first aperture for alignment with a line of sight of optics of the scope and a rim positioned about the first aperture, the support body comprising a mounting portion for mounting to the eyepiece;

a cap defining a second aperture, the cap pivotably mounted to the support body at the mounting portion and movable between a closed position in approximation with the rim of the support body such that the first aperture and the second aperture are in alignment with the line of sight of the optics of the scope, and an open position wherein the second aperture is not in alignment with the line of sight of the optics of the scope;

a biasing member in engagement with the support body and the cap for biasing the cap towards the open position;

a first removable disc configured for placement within the second aperture wherein the first removable disc is opaque;

a second removable disc that displays ballistic DOPE configured for placement within the second aperture; and a third removable disk configured to secure the first and second removable discs in the cap, wherein the third removable disc is transparent.

2. The scope cap assembly of claim 1, comprising a retaining mechanism configured to releasably secure the cap in the open position.

3. The scope cap assembly of claim 2, wherein the retaining mechanism comprises a raised protrusion and a recess.

4. The scope cap assembly of claim 2, wherein the retaining mechanism releasably secures the cap at an intermediate position between the closed position and the open position.

5. The scope cap assembly of claim 1, further comprising a resilient sleeve for resiliently mounting the cap about an outer portion of the eyepiece end of the scope of the firearm.

6. The scope cap assembly of claim 1, wherein the second removable disc that displays ballistic DOPE is visible to a user through the third removable disk when the cap is in the open position.

7. The scope cap assembly of claim 1, further comprising a washer disposed proximate to the second aperture.

8. The scope cap assembly of claim 1, wherein the biasing member is a torsion spring.

9. The scope cap assembly of claim 1, wherein the cap further comprises a release lever.

10. The scope cap assembly of claim 1 further comprising a pin disposed between the mounting portion of the support body and the cap to allow pivotable movement of the cap.

11. A scope cap assembly for mounting on an eyepiece end of a scope of a firearm, comprising:

a support body defining a first aperture for alignment with a line of sight of optics of the scope and a rim positioned about the first aperture, the support body comprising a mounting portion for mounting to the eyepiece;

a cap defining a second aperture therethrough, the cap pivotably mounted to the support body at the mounting portion and movable between a closed position in approximation with the rim of the support body such that the first aperture and the second aperture are in alignment with the line of sight of the optics of the scope, and an open position, wherein the second aperture is not in alignment with the line of sight of the optics of the scope;

a biasing member in engagement with the support body and the cap for biasing the cap towards the open position;

a first removable disc configured for placement within the second aperture wherein the first removable disc is transparent;

a second removable disc that displays ballistic DOPE configured for placement within the second aperture; and a third removable disk configured to secure the first and second removable discs in the cap, wherein the third removable disc is opaque.

12. The scope cap assembly of claim 11, comprising a retaining mechanism configured to releasably secure the cap in the open position.

13. The scope cap assembly of claim 12, wherein the retaining mechanism comprises a raised protrusion and a recess.

14. The scope cap assembly of claim 12, wherein the retaining mechanism releasably secures the cap at an intermediate position between the closed position and the open position.

15. The scope cap assembly of claim 11, further comprising a resilient sleeve for resiliently mounting the cap about an outer portion of the eyepiece end of the scope of the firearm.

16. The scope cap assembly of claim 11, wherein the second removable disc that displays ballistic DOPE is visible to a user through the first removable disk when the cap is in the closed position.

17. The scope cap assembly of claim 11, further comprising a washer disposed proximate to the second aperture.

18. The scope cap assembly of claim 11, wherein the cap further defines a release lever.

19. The scope cap assembly of claim 11, further comprising a pin disposed between the mounting portion of the support body and the cap to allow pivotable movement of the cap.

20. The scope cap assembly of claim 11, wherein the biasing member is a torsion spring.

* * * * *